US008465324B2

(12) United States Patent
Ikari et al.

(10) Patent No.: US 8,465,324 B2
(45) Date of Patent: Jun. 18, 2013

(54) ELECTRIC CONNECTOR AND ELECTRIC CONNECTOR ASSEMBLY

(75) Inventors: Hiroharu Ikari, Machida (JP); Tetsuya Tagawa, Machida (JP); Tatsuo Shiiya, Machida (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 13/286,619

(22) Filed: Nov. 1, 2011

(65) Prior Publication Data

US 2012/0094519 A1 Apr. 19, 2012

(30) Foreign Application Priority Data

May 7, 2010 (JP) ..... 2010-107603

(51) Int. Cl.
*H01R 13/648* (2006.01)

(52) U.S. Cl.
USPC ..... 439/607.31; 439/495

(58) Field of Classification Search
USPC ..... 439/607.31, 607.01, 607.35, 607.4, 439/495, 496
See application file for complete search history.

(56) References Cited

U.S. PATENT DOCUMENTS

| | | | | |
|---|---|---|---|---|
| 6,733,326 | B2 * | 5/2004 | Lee | 439/495 |
| 6,855,002 | B2 * | 2/2005 | Chiu | 439/495 |
| 6,949,316 | B2 * | 9/2005 | Aoki | 439/260 |
| 7,371,095 | B2 * | 5/2008 | Takahashi | 439/261 |
| 7,931,492 | B1 * | 4/2011 | Chen | 439/495 |
| 7,997,924 | B2 * | 8/2011 | Yu | 439/495 |
| 8,021,187 | B2 | 9/2011 | Tagawa et al. | |
| 2003/0220013 | A1 * | 11/2003 | Lee | 439/495 |
| 2005/0287865 | A1 * | 12/2005 | Wang et al. | 439/495 |
| 2007/0066127 | A1 * | 3/2007 | Inoue | 439/495 |
| 2009/0305561 | A1 * | 12/2009 | Yao et al. | 439/607.4 |
| 2010/0159747 | A1 * | 6/2010 | Chang | 439/607.35 |
| 2011/0086546 | A1 * | 4/2011 | Mao et al. | 439/607.4 |

OTHER PUBLICATIONS

U.S. Appl. No. 13/348,916, filed Jan. 12, 2012, Tagawa, et al.
U.S. Appl. No. 13/150,731, filed Jun. 1, 2011, Ikari, et al.

* cited by examiner

*Primary Examiner* — Gary F. Paumen
(74) *Attorney, Agent, or Firm* — Oblon, Spivak, McClelland, Maier & Neustadt, L.L.P.

(57) ABSTRACT

To allow electromagnetic shielding regarding a connecting portion between conductive contacts and a main wiring board to be excellently achieved with a simple structure without impairing productivity, a fit-in holding member being rotated from a fit-in releasing position to a fit-in acting position to maintain a state where connectors fit in together by rotation is provided with a conductive cover part covering a connecting portion between a counterpart connector and the main wiring board when the fit-in holding member is rotated to the fit-in acting position, and the connecting portion is covered with the conductive cover part. Electromagnetic shielding of that portion is performed simultaneously with the time when both of the connectors fit in together, thereby eliminating an increase in the number of manufacturing processes. Also, the connection state at the connecting portion between a conductive contact and and the main wiring board can be clearly confirmed until the fit-in holding member is rotated to the fit-in acting position.

7 Claims, 6 Drawing Sheets

ELECTRIC CONNECTOR AND ELECTRIC CONNECTOR ASSEMBLY

BACKGROUND OF THE INVENTION

1. Field of the Invention

The present invention relates to an electric connector and electric connector assembly with a fit-in structure for electrically connecting any appropriate signal transmission medium to a main wiring board.

2. Description of the Related Art

In general, in various electric devices and others, an electric connector is widely used for connecting a terminal part of a signal transmission medium formed of a flexible printed circuit (FPC), a flexible flat cable (FFC), a coaxial cable, or others to a main printed wiring board. The electric connector is configured in a manner such that, to a first connector (a receptacle connector) mounted on a main printed wiring board, a second connector (a plug connector) to which a signal transmission medium such as a coaxial cable is inserted and both of the connectors fit in together. Signal transmission is performed though conductive contacts (conductive terminals) arranged in a multipolar manner inside a body housing.

In this electric connector, to reduce an influence of external electromagnetic noise on a transmission signal or to reduce electromagnetic noise emitted toward the outside, the structure has been conventionally adopted such that the outer surface of the body housing is covered with a metal-thin-plate-like conductive shell for electromagnetic shielding (refer to Japanese Unexamined Patent Application Publication No. 2007-73426).

However, the conventional electric connector has the structure such that only the outer surface of the body housing is covered with the conductive shell, and the terminal part of the conductive contacts (conductive terminals) described above, more specifically, a connecting portion with the main wiring board, is not covered with the conductive shell and is exposed to the outside. Therefore, with an increase in frequency of the transmission signal particularly in recent years, the influence of external electromagnetic noise on the connecting portion with the main wiring board has been becoming impossible to ignore, and the possibility of emission of electromagnetic noise from the connecting portion to the outside has been increasing.

Note that, conventionally, a conductive tape is affixed to the connecting portion between the conductive contacts and the main wiring board, or the conductive shell is extended to cover that portion. When the conductive tape is used, however, a relatively bothersome working process of affixing the conductive tape is added, and therefore productivity tends to decrease. Moreover, when the conductive shell is extended for coverage, the connecting portion between the conductive contacts and the main wiring board cannot be checked by a visual inspection, an image inspection, or the like, thereby disadvantageously making it difficult to conduct an inspection and a check to see whether the connection works without any trouble.

Furthermore, in the conventional electric connector, a ground bar may be used to connect a plurality of coaxial cables arranged in a multipolar manner for spreading, and part of the conductive shell may be soldered to that ground bar. At the time of solder connection between the conductive shell and the ground bar, a flux contained in a solder material is abruptly blown due to heating of the solder material, and therefore the solder material and the flux scatter to be adhered to a portion other than the originally-intended connecting portion, for example, a contact portion of the conductive contacts, thereby possibly causing an electrical problem.

SUMMARY OF THE INVENTION

Thus, an object of the present invention is to provide an electric connector and electric connector assembly allowing electromagnetic shielding regarding a connecting portion with a main wiring board to be excellently achieved with a simple structure without impairing productivity.

Also, another object of the present invention is to provide an electric connector and electric connector assembly allowing adherence of foreign substances, such as a solder material, to a contact portion of conductive contacts to be excellently prevented with a simple structure.

To achieve the objects described above, in the present invention, the structure is adopted such that, in an electric connector assembly including a first connector having coupled thereto a terminal part of a signal transmission medium and a second connector which the first connector fits in as being connected to a main wiring board in a mounted state, with a fit-in holding member provided to any one of the connectors being rotated from a fit-in releasing position to a fit-in acting position in a state where both of the connectors fit in together, the electric connector assembly being configured to maintain the state where both of the connector fit in together, the fit-in holding member is provided with a conductive cover part covering a connecting portion between the second connector and the main wiring board when the fit-in holding member is rotated to the fit-in acting position in the state where both of the connectors fit in together.

According to the present invention with the above-described structure, with the fit-in holding member being rotated from the fit-in releasing position to the fit-in acting position after both of the connectors fit in together, the connecting portion with the main wiring board is covered with the conductive cover part. Therefore, electromagnetic shielding of the connecting portion with the main wiring board is immediately performed simultaneously with the operation of rotating the fit-in holding member when both of the connectors fit in together, and therefore the number of manufacturing processes is not increased. Also, since the connecting portion with the main wiring board is not covered with the conductive cover part until the fit-in holding member is rotated to the fit-in acting position, the connection state at the connecting portion can be clearly confirmed.

Also, in the present invention, the structure is adopted such that, in an electric connector fitting in a counterpart connector mounted by being connected to a main wiring board in a state where a terminal part of a signal transmission medium is coupled to the electric connector, with the fit-in holding member being rotated from a fit-in releasing position to a fit-in acting position in a state of fitting in the counterpart connector, the electric connector being configured to maintain the state of fitting in the counterpart connector, the fit-in holding member is provided with a conductive cover part covering a connecting portion between the counterpart connector and the main wiring board when the fit-in holding member is rotated to the fit-in acting position in the state of fitting in the counterpart connector.

According to the present invention with the above-described structure, with the fit-in holding member being rotated from the fit-in releasing position to the fit-in acting position after fitting in the counterpart connector, the connecting portion between the counterpart connector and the main wiring board is covered with the conductive cover part. Therefore, electromagnetic shielding of the connecting portion with the main wiring board is immediately performed simultaneously with the operation of rotating the fit-in holding member when both of the connectors fit in together, and therefore the number of manufacturing processes is not increased. Also, since the connecting portion between the counterpart connector and the main wiring board is not covered by the conductive cover part until the fit-in holding member is rotated to the fit-in acting position, the connection state at the connecting portion can be clearly confirmed.

Furthermore, in the present invention, the structure is adopted such that, in an electric connector fitting in a counterpart connector mounted by being connected to a main wiring board in a state where a terminal part of a signal transmission medium being coupled to the electric connector, the electric connector being configured to maintain a state of fitting in the counterpart connector by being rotated from a fit-in releasing position to a fit-in acting position in the state of fitting in the counterpart connector, the electric connector being provided with a conductive contact having a contact part in contact with a conductive contact of the counterpart connector at the time of fitting in the counterpart connector, the fit-in holding member is configured to cover at least the contact part of the conductive contact when the fit-in holding member is rotated to the fit-in acting position in a state of not fitting in the counterpart connector.

According to the present invention with the above-described structure, with the fit-in holding member being rotated to the fit-in acting position before fitting in the counterpart connector, the contact portion of the conductive contacts to be connected to the counterpart connector is covered with the conductive cover part for protection. Therefore, adherence of foreign substances, such as a solder material, to the contact portion can be prevented, thereby ensuring excellent electrical connection.

Furthermore, in the present invention, the structure is possible such that the fit-in holding member includes a pair of coupling arm parts extending from rotational shaft parts provided at both ends in a connector longitudinal direction and a rotation operating part connecting both of the coupling arm parts, and the rotation operating part is provided with the conductive cover part.

Still further, in the present invention, the structure is possible such that, when the fit-in holding member is rotated to the fit-in acting position, the conductive cover part is configured to cover a connector upper surface and both of connector side surfaces.

According to the present invention with the above-described structure, the entire connector is covered with the conductive cover part. Therefore, an excellent electromagnetic shielding function can be achieved, and the stiffness of the fit-in holding member can be increased by the extended conductive cover part.

As described above, in the present invention, the fit-in holding member being rotated from the fit-in releasing position to the fit-in acting position to maintain a connector fit-in state is provided with the conductive cover part covering the connecting portion between the counterpart connector and the main wiring board when the fit-in holding member is rotated to the fit-in acting position in the state of fitting in the counterpart connector. When both of the connectors fit in together, the connecting potion between the conductive contacts and the main wiring board is covered to immediately cause electromagnetic shielding of that connecting portion, thereby eliminating an increase in the number of manufacturing processes. Also, the connection state at the connecting portion with the main wiring board can be clearly confirmed until the fit-in holding member is rotated to the fit-in acting position. Therefore, electromagnetic shielding regarding the connecting portion with the main wiring board can be excellently achieved with a simple structure without impairing productivity, and reliability of the electric connector can be significantly increased at low cost.

Also, in the present invention, the fit-in holding member being rotated from the fit-in releasing position to the fit-in acting position to maintain a connector fit-in state is provided with the conductive cover part covering the contact portion of the conductive contacts when the fit-in holding member is rotated to the fit-in acting position when not fitting in the counterpart connector. With the fit-in holding member being rotated to the fit-in acting position before fitting in the counterpart connector, the contact portion of the conductive contacts to be connected to the counterpart connecter is covered with the conductive cover part for protection. Therefore, adherence of foreign substances, such as a solder material, to the contact portion can be prevented, thereby ensuring excellent electrical connection. Thus, adherence of foreign substances, such as a solder material, to the contact portion of the conductive contacts can be excellently prevented with a simple structure, and reliability of the electric connector can be significantly increased at low cost.

DETAILED DESCRIPTION OF THE PREFERRED EMBODIMENTS

Embodiments when the present invention is applied to an electric connector for connecting a plurality of coaxial cables to a printed wiring board side are described in detail below based on the drawings.

[Summary of Entire Structure of Electric Connector Assembly]

Figure 7:
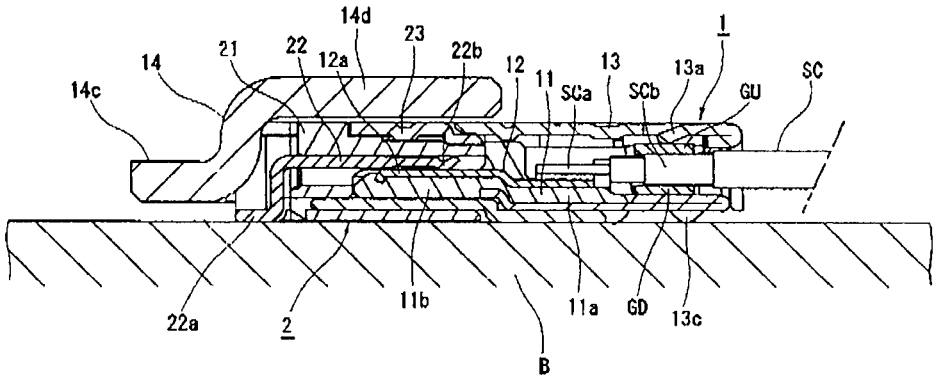
FIG. 7 is a descriptive cross-section view along a line in FIG. 3.

First, an electric connector assembly according to a first embodiment of the present invention depicted in FIGS. 1 to 7 configures a horizontal fit-in type electric connector including a plug connector 1 to which a terminal portion of coaxial cables SC are coupled and a receptacle connector 2 mounted on a main printed wiring board B. The plug connector 1 as a first connector is arranged so as to face the receptacle connector 2 as a second connector, which is a fit-in counterpart, in an approximately horizontal direction. From this state, with the plug connector 1 is moved so as to come close along the surface of the main printed wiring board B, as depicted in FIG. 7, a tip projection part of the plug connector 1 is inserted into an opening of the receptacle connector 2, thereby causing both of the connectors 1 and 2 to fit in together.

As such, in the present embodiment, a direction in which the plug connector (first connector) 1 is inserted in the receptacle connector (second connector) 2 and its reverse direction for extraction are approximately matched with a surface extending direction of the main printed wiring board B. In the following, a direction in which the surface of the main printed wiring board B extends is assumed to be a horizontal direction, and a direction orthogonal to the surface of the main printed wiring board B is assumed to be a vertical direction. Also, in the plug connector 1, a direction in which the plug connector 1 is inserted in the receptacle connector 2 as a counterpart connector is assumed to be a forward direction, and its reverse direction for extraction is assumed to be a backward direction. Furthermore, in the receptacle connector 2 as a counterpart connector, a direction in which the plug connector 1 is extracted from the receptacle connector 2 is assumed to be a forward direction, and its reverse direction is assumed to be a backward direction.

Both of the connectors, that is, the plug connector (first connector) 1 and the receptacle connector (second connector) 2 configuring the electric connector assembly include body housings 11 and 21, respectively, formed of an elongated insulating member. In these insulating body housings 11 and 21, many conductive contacts (conductive terminals) 12 and 22 are arranged along a longitudinal direction of the body housings 11 and 21, respectively (a direction perpendicular to the sheet of FIG. 7), at appropriate pitch spacing so as to form a multipolar shape.

Among these connectors 1 and 2, to an end edge on a rear side of the plug connector (first connector) 1 (hereinafter referred to as a rear end edge), a terminal portion of the plurality of coaxial cables SC arranged in parallel in a mutlipolar manner is coupled. At the terminal portion of the coaxial cables SC, cable center conductors (signal lines) SCa and cable outer conductor (shield lines) SCb are coaxially exposed by peeling off a coating material. With each cable center conductors SCa arranged along a center axis line of each coaxial cable SC being connected to a conductive contact (conductive terminal) for signal transmission, which will be described further below, a signal circuit is configured. The connection structure of the cable center conductors SCa is described further below in detail.

The cable outer conductors SCb arranged so as to surround an outer perimeter side of the cable center conductors SCa are arranged so as to be interposed between an upper ground bar GU and a lower ground bar GD configuring a ground member. With these ground bars GU and GD being connected together by soldering, swaging, pressure welding, or the like, a ground circuit is configured. Here, the upper ground bar GU and the lower ground bar GD are each formed of an elongated band-plate-like member extending long along a multipolar arrangement direction, and are collectively connected by using a long soldering member or the like in the state where they are placed along the upper and lower surfaces of the cable outer conductors (shield lines) SCb of the coaxial cables SC arranged in a multipolar manner described above. Also, both of these ground bars GU and GD are configured to have a ground connection via a conductive shell, which will be described further below, or the like.

[Body Housing and Conductive Contacts]

On the other hand, both of the plug connector (first connector) 1 and the receptacle connector (second connector) 2 described above include body housings 11 and 21, respectively, each made of an insulating material formed in an elongated shape. In these insulating body housings 11 and 21, many conductive contacts (conductive terminals) 12 and 22, respectively, are arranged along a connector longitudinal direction (the direction perpendicular to the sheet of FIG. 7) at appropriate pitch spacing so as to form a multipolar shape. Of these plurality of conductive contacts 12 and 22, adjacent ones in the multipolar arrangement direction (connector longitudinal direction) described above are formed so as to have an approximately same shape made of an approximately same material, and the conductive contacts 12 and 22 are arranged as being buried in the body housings 11 and 21, respectively, by insert molding or press fitting.

With the cable center conductors SCa of the coaxial cables SC being solder-connected to the conductive contacts 12 provided to the plug connector (first connector) 1, the conductive contacts 12 of the plug connector 1 are elastically brought into contact with the conductive contacts 22 provided to the receptacle connector (second connector) 2, thereby configuring a signal transmission circuit. Note that these conductive contacts 12 and 22 can be configured for the purpose of ground connection.

Here, of the body housings 11 and 21 of the connectors 1 and 2, respectively, described above, the body housing 11 provided on the plug connector (first connector) 1 side integrally includes a body support part 11*a* arranged inside the plug connector 1 and a fit-in projection part 11*b* projecting from the body support part 11 to a front side. Along an upper surface from the body support part 11*a* to the fit-in projection part 11*b*, the conductive contacts (conductive terminals) 12 described above are arranged so as to extend approximately horizontally. On the upper surface of the body support part 11*a* where rear side portions of the conductive contacts 12 are arranged, a connection structure portion with the coaxial cables SC described above is arranged. To the rear-side extending portion of the conductive contacts 12 arranged on the body support part 11*a*, the cable center conductors (signal lines) SCa of the coaxial cables SC are solder-jointed so as to be placed and abut from an upper side. This solder joint between the plurality of cable center conductors SCa and conductive contacts 12 is collectively performed.

Also, on an upper surface of the fit-in projection part 11*b* provided at a front end side of the body housing 11, terminal electrode parts 12*a* configuring a front side portion of the conductive contacts 12 are arranged at appropriate pitch spacing so as to form a multipolar shape. The terminal electrode parts 12*a* configuring a front-side extending portion of the conductive contacts 12 are electrically in contact with the receptacle connector (second connector) 2 side.

Furthermore, the conductive contacts (conductive terminals) 22 mounted on the body housing 21 of the receptacle connector (second connector) 2 are each provided with a solder connection part 22*a* with its side surface forming an approximately L shape at a rear end portion (a left end portion in FIG. 7). At the time of practical use, the solder connection parts 22*a* are placed on a signal conductive path or a ground conductive path on the main printed wiring board B described above, and then are collectively solder-jointed.

The conductive contacts (conductive terminals) 22 in the present embodiment each rise approximately vertically upward from the solder connection part 22*a* at the rear end side described above, and extend in a cantilever shape from a rising upper end to a front side (a right side in FIG. 7). At a tip portion on the front side of each conductive contacts 22, a contact protrusion 22*b* is provided jutting toward a lower side in an inverted mountain shape. A lower end side apex of the contact protrusion 22*b* provided to the conductive contact 22 is configured to spring-elastically make contact with the terminal electrode part 12*a* of the conductive contact 12 on the plug connector 1 side when the plug connector (first connector) 1 fits in the receptacle connector (second connector) 2. With this contact relation, an electrical connection between the contact parts 12*a* and 22*b* can be achieved.

[Conductive Shell of First Connector]

On the other, both of the upper and lower surfaces of each of the body housings 11 and 21 provided to the plug connector (first connector) 1 and the receptacle connector (second connector) 2 are covered with conductive shells 13 and 23, respectively, each formed of a thin-platelike metal member bent in an appropriate shape. These conductive shells 13 and 23 are mounted as members providing electromagnetic shielding by covering the signal transmission circuit and the ground circuit formed inside of the connectors 1 and 2, respectively, and are also members configuring part of the ground circuit.

Figure 4:
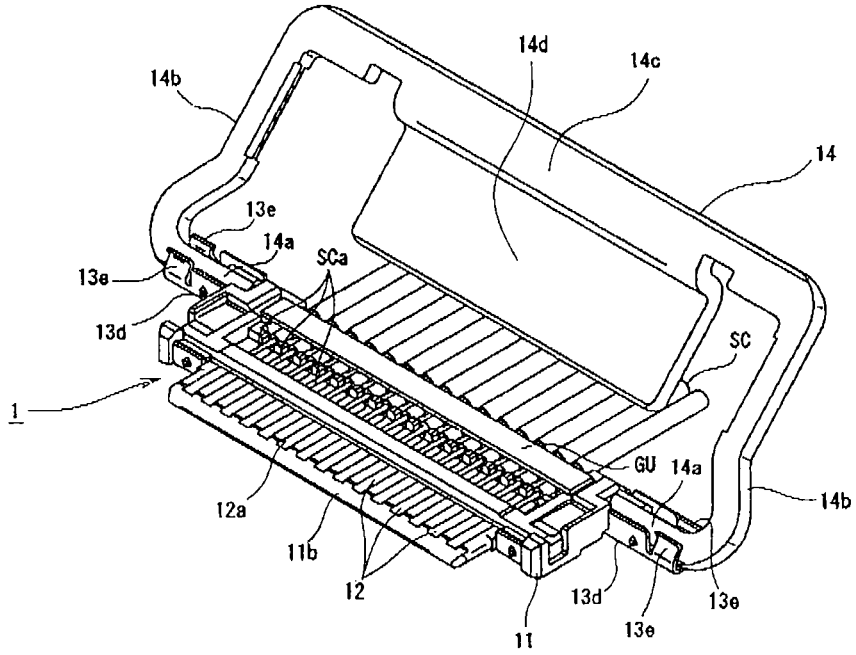
FIG. 4 is a descriptive external perspective view of the electric connector in a state where an upper conductive shell is removed from the plug connector (the first connector) of FIG. 1.

Here, while a lower-half-side portion of the conductive shell 13 provided on the plug connector (first connector) 1 side is integrally formed with the body housing 11 by insert molding, an upper-half-side portion of the conductive shell 13 is mounted so as to cover the body housing 11 from above after both of the ground bars (ground members) GU and GD are solder-jointed to the coaxial cables SC as depicted in FIG. 4. On the upper surface side of this conductive shell 13, a plurality of ground connection tongues 13*a* are formed each in the form of a notch along the connector longitudinal direction, which is a multipolar arrangement direction. Each of these ground connection tongue 13*a* is raised toward a diagonally lower side so as to form a cantilever plate spring shape, and is solder-jointed to or in elastic contact with the upper surface side of the upper ground bar GU described above.

Here, the plug connector (first connector) 1 according to the present embodiment is configured to fit in by being moved along the surface of the main printed wiring board B where the receptacle connector (second connector) 2 as a counterpart connector mounted as described above. At a bottom-side rear-end portion of the conductive shell 13 mounted on the plug connector 1, a plurality of rear support parts 13*c* slidably contacting the surface of the main printed wiring board B are provided at a plurality of positions. These rear support parts 13*c* have a function of lifting the rear end portion of the plug connector 1 by the height of the rear support parts 13*c*.

That is, when the lower surface of the fit-in projection part 11*b* of the plug connector (first connector) 1 makes contact with an inner side bottom surface of the conductive shell 23 provided to the receptacle connector (second connector) 2 described above, the rear support parts 13*c* of the plug connector 1 slidably make contact with the surface of the main printed wiring board B, thereby approximately horizontally maintaining the entire plug connector 1 along the surface of the main printed wiring board B. The rear support parts 13*c* according to the present embodiment can be each formed in the form of a so-called dimple shape, which is formed by, for example, denting the metal plate configuring the conductive shell 13 from above to an opposite side, that is, to below, to form a convex from a bottom surface part.

[Conductive Shell of Second Connector]

On the other hand, in the conductive shell 23 provided to the receptacle connector (second connector) 2, each of both end portions in the connector longitudinal direction the and rear end portions is provided with a hold-down 23*a* formed by being bent so as to project outward. Each of these hold-downs 23*a* is solder-jointed to a ground conductive path (not shown) formed on the main printed wiring board B, thereby achieving an electrical connection of the ground circuit and also strongly fixing the entire receptacle connector 2.

[Fit-In Holding Member]

Next, a fit-in state of both of the connectors 1 and 2 in which the plug connector (first connector) 1 fits in the receptacle connector (second connector) 2 is configured to be maintained by a fit-in rotating arm 14 provided to the plug connector 1 as a fit-in holding member. Also, the structure is such that the plug connector 1 fitting in the receptacle connector 2 can be extracted from the receptacle connector 2 by pulling the fit-in rotating arm 14.

That is, the fit-in rotating arm (fit-in holding member) 14 is rotatably mounted on the conductive shell 13 of the plug connector 1 described above, and rotating shaft parts 14*a* provided at both end portions of the fit-in rotating arm 14 in the connector longitudinal direction are rotatably inserted in bearing parts 13*d* provided at both end portions of the rear end portion of the conductive shell 13 in the connector longitudinal direction in an idle fit-in state. The paired rotating shaft parts 14*a* provided to the fit-in rotating arm 14 are each formed so as to have a cross section in an approximately rectangular shape, and are each configured so that a pressing force of a spring regulating member 13*e* provided to the bearing part 13*d* is exerted onto any flat surface configuring an outer perimeter surface of the rotating shaft part 14*a*. With the pressing force of the spring regulating member 13*e*, the rotating shaft part 14*a* is lightly held at a "fit-in releasing position" and a "fit-in acting position", which will be described further below.

Also, from an outer end portion of the rotating shaft part 14*a* in the connector longitudinal direction described above, a coupling arm part 14*b* extends approximately along a rotating radius direction. Tip portions on a rotating side, that is, extended end portions, of the coupling arm portions 14*b* are integrally coupled together by a rotating operation part 14*c* extending in an approximately straight line along the connector longitudinal direction. With part of the rotating operation part 14*c* being held by an operator to exert an appropriate rotating force, the entire fit-in rotating arm 14 is rotated between the "fit-in releasing position" depicted in FIG. 2 and the "fit-in acting position" depicted in FIG. 3.

Here, the conductive shell 23 provided to the receptacle connector (second connector) 2 is provided with a lock part 23*b* in which the coupling arm part 14*b* of the fit-in rotating arm (fit-in holding member) 14 rotated at the "fit-in acting position" lightly fits, the lock part 23*b* jutting outward in the connector longitudinal direction. Then, with the plug connector (first connector) 1 fitting in the receptacle connector (second connector) 2 as described above, the fit-in rotating arm 14 is rotated to a position near the "fit-in acting position", each coupling arm part 14*b* provided to the fit-in rotating arm 14 is rotated so as to go over the externally jetting portion of the lock part 23*b*. Immediately after the coupling arm part 14*b* of the fit-in rotating arm 14 goes over the lock part 23*b*, the lock part 23*b* is elastically pressed onto the upper surface side of the coupling arm part 14*b* of the fit-in rotating arm 14, thereby elastically holding the entire fit-in rotating arm 14 at the "fit-in acting position". As such, in this structure, with the plug connector (first connector) 1 fitting in the receptacle connector (second connector) 2, when the fit-in rotating arm 14 is rotated from the "fit-in releasing position" to the "fit-in acting position", both of the connectors 1 and 2 are not separated and are maintained in a fit-in state.

Furthermore, the rotating operation part 14*c* of the fit-in rotating arm (fit-in holding member) 14 described above is integrally provided with a conductive cover part 14*d* formed of a plate-like member. This conductive cover part 14*d* is provided so as to extend in an approximately flat shape from an inner-perimeter-side end edge of the rotating operation part 14*c* to a rotating radius inner side (a right side in FIG. 6). As depicted particularly in FIG. 3, with both of the connectors 1 and 2 fitting in together, when the fit-in rotating arm 14 is rotated to the "fit-in acting position", a connecting portion between the receptacle connector (second connector) 2 and the main wiring board B, that is, the above-described solder connection parts 22*a*, is covered with the conductive cover part 14*d* from above. As such, the conductive cover part 14*d* has a form along a step shape of the solder connection parts 22*a*, and has a width dimension in the connector longitudinal direction set equivalent to an arrangement width of the solder connection parts 22*a*.

Also, as described above, the conductive cover part 14*d* is configured to be provided to the plug connector (first connector) 1. As depicted particularly in FIG. 5, in the state where the plug connector 1 is alone without fitting in the receptacle connector (second connector) 2 as a counterpart connector, when the fit-in rotating arm (fit-in holding member) 14 is rotated to the "fit-in acting position", the structure is such that the conductive cover part 14*d* of the fit-in rotating arm 14 almost entirely covers the terminal electrode parts 12*a* of the conductive contacts (conductive terminals) 12 from above. More specifically, the structure is such that an inner end edge of the flat-plate-like member configuring the conductive cover part 14*d* extending from the inner-perimeter side end edge to the rotating radius inner side is arranged near tip positions of the cable center conductors SCa of the coaxial cables SC described above, and the terminal electrodes parts 12*a* of the conductive contacts 12 are covered with the conductor cover part 14*d*.

Figure 5:
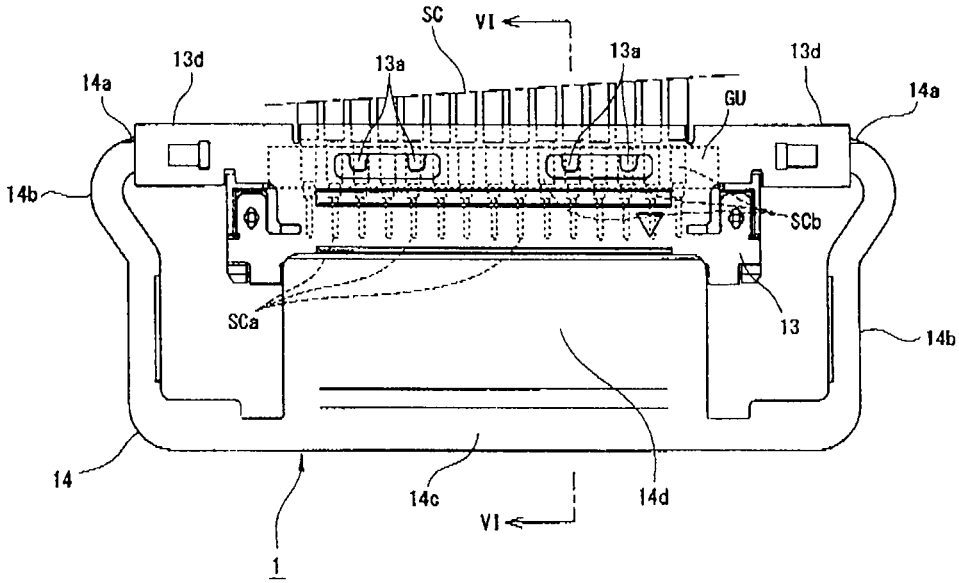
FIG. 5 is a descriptive plan view of only the plug connector (the first connector) in the state of FIG. 3.
Figure 6:
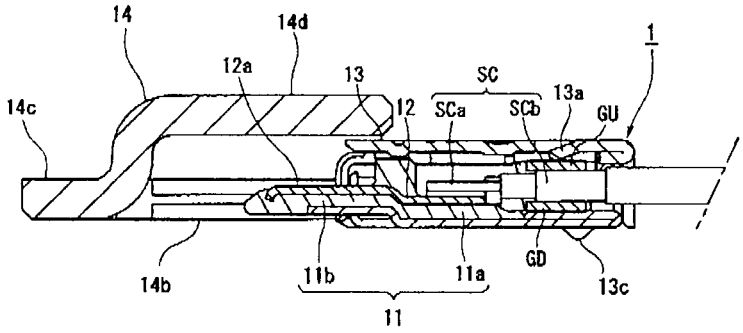
FIG. 6 is a descriptive cross-section view along a VI-VI line in FIG. 5.

On the other hand, the conductive cover part 14*d* is configured not to cover the ground connection tongues 13*a* provided on the upper surface side of the conductive shell 13 described above when the fit-in rotating arm 14 is rotated to the "fit-in acting position". That is, the inner end edge of the conductive cover part 14*d* on the rotating radius inner side described above is formed so as to extend to a position corresponding to a position back from the ground connection tongues 13*a*. For example, as depicted in FIG. 5, with the coaxial cables SC connected to the upper and lower ground bars GU and GD, the fit-in rotating arm 14, and the conductive shell 13 being mounted on the body housing 11, when the fit-in rotating arm 14 is rotated to the "fit-in acting position", the terminal electrode parts 12*a* of the conductive contacts (conductive terminals) 12 are covered with the conductive cover part 14*d* from above. On the other hand, the ground connection tongues 13*a* are in an exposed state without being covered. With this, a solder-joint operation on the upper ground bar GU of the ground connection tongues 13*a* is excellently performed without obstruction by the conductive cover part 14*d*. Furthermore, when a solder connecting operation is performed on the upper ground bar GU of the ground connection tongues 13*a*, adherence of a scattered solder member or the like to the terminal electrode parts 12*a* of the conductive contacts 12 is prevented by the conductive cover part 14.

Figure 1:
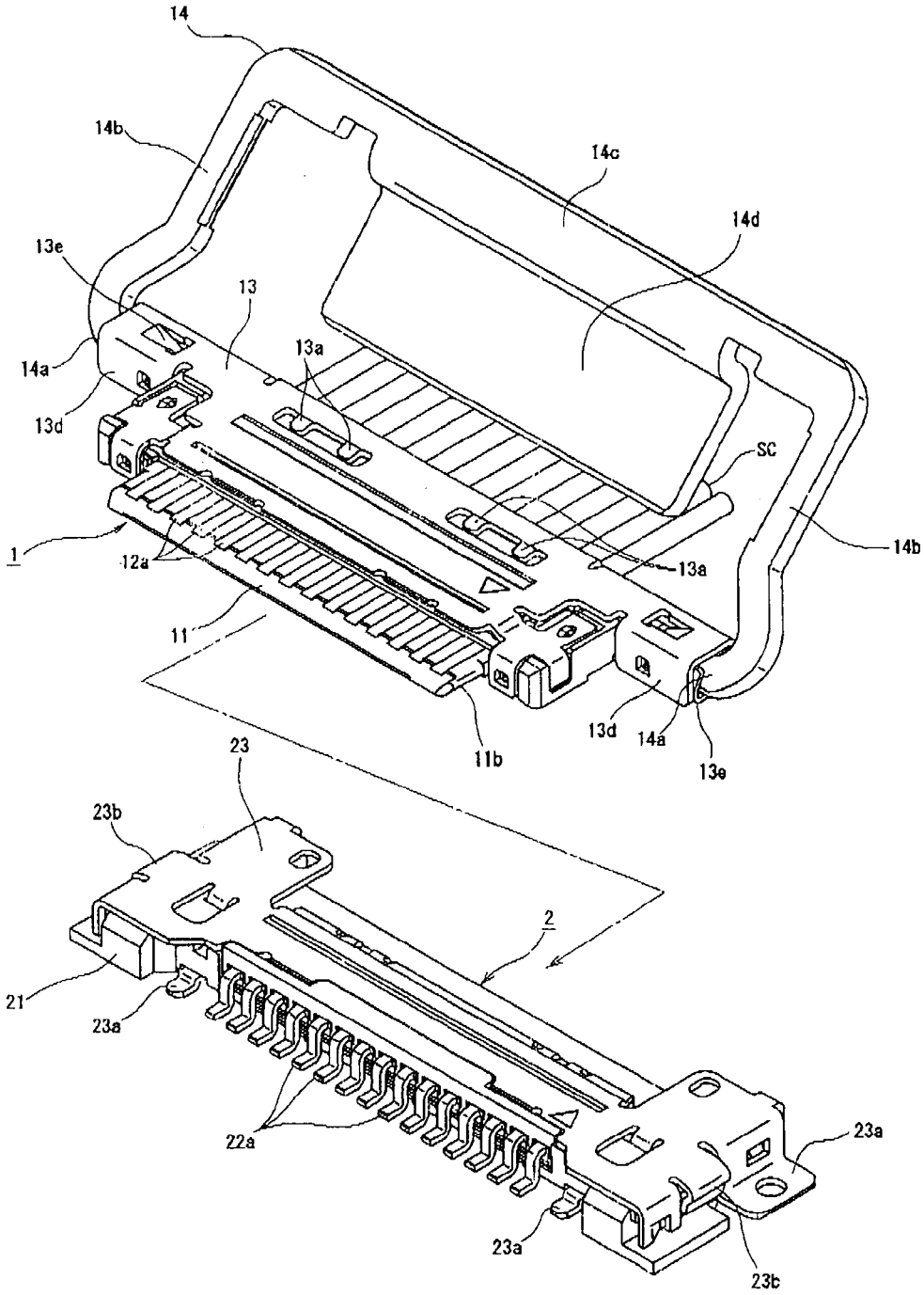
FIG. 1 is a descriptive external perspective view of an electric connector assembly according to an embodiment of the present invention in a state before a plug connector (a first connector) fits in a receptacle connector (a second connector) as a counterpart connector.
Figure 2:
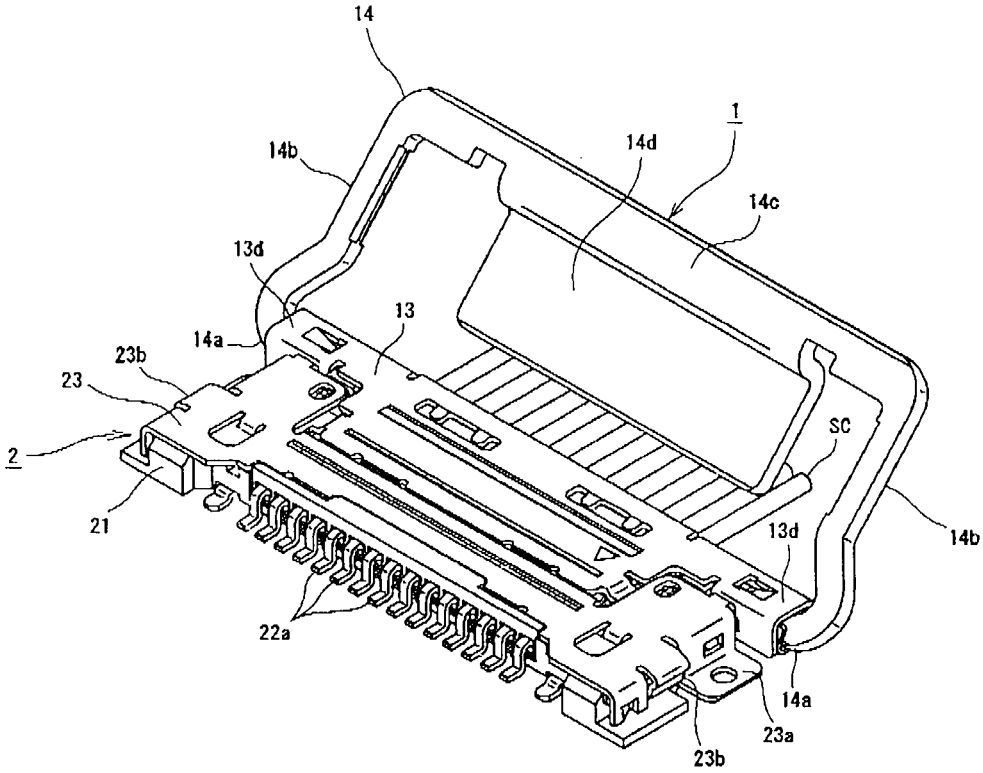
FIG. 2 is a descriptive external perspective view of the electric connector assembly in a state from the state of FIG. 1 after the plug connector (the first connector) fits in the receptacle connector (the second connector)
Figure 3:
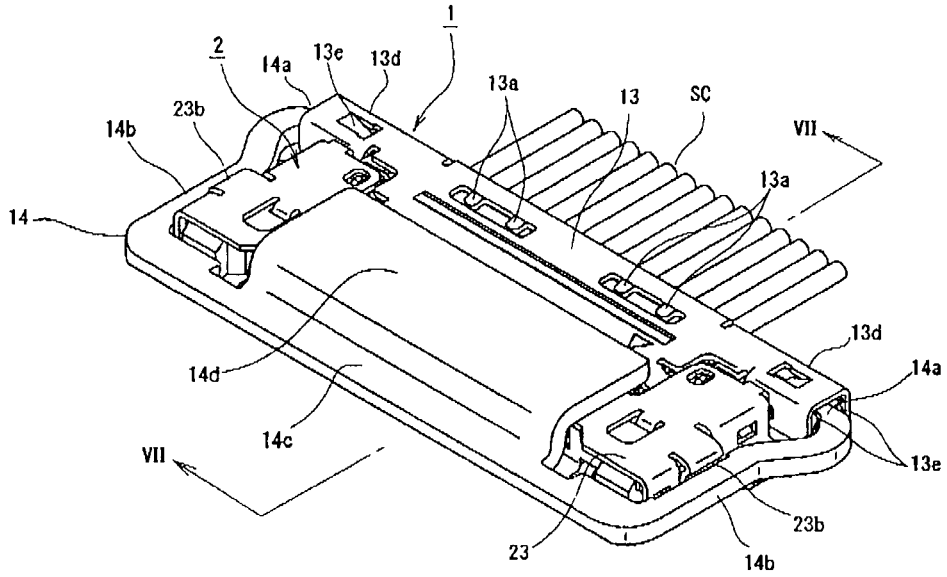
FIG. 3 is a descriptive external perspective view of the electric connector assembly in a state after a fit-in rotating arm (a fit-in holding member) at a "fit-in releasing position" in FIG. 2 is rotated to a "fit-in acting position)

Note that, in the present embodiment, as depicted particularly in FIGS. 3 and 7, when the plug connector (first connector) 1 and the receptacle connector (second connector) 2 fit in together, open edge pars of both of the conductive shells 13 and 23 are configured to fit in together so as to be vertically stacked with each other. A stacked fit-in part between both of the conductive shells 13 and 23 is configured to be covered with the above-described conductive cover part 14. More specifically, as depicted in FIGS. 3 and 7, with the plug connector 1 and the receptacle connector 2 fitting in together, when the fit-in rotating arm 14 is rotated to the "fit-in acting position", the stacked joint part between the conductive shell 13 of the plug connector 1 and the conducive shell 23 of the receptacle connector 2 is preferably configured to be covered with the conductive cover part 14*d* from above. That is, with the plug connector 1 and the receptacle connector 2 fitting in together, the inner end edge of the conductive cover part 14*d* on a rotating radius inner side is formed to extend to the stacked joint part between the conductive shell 13 of the plug connector 1 and the conducive shell 23 of the receptacle connector 2 on a connector upper side. With this structure, a function of better electromagnetic shielding of the stacked joint portion between the conductive shells 13 and and 23 can be achieved.

According to the first embodiment of the present invention with the above-described structure, after both of the connectors 1 and 2 fit in together, the fit-in rotating arm (fit-in holding member) 14 provided to the plug connector (first connector) 1 is rotated from the "fit-in releasing position" to the "fit-in acting position", thereby causing the solder connection part 22*a*, which is a connecting portion between the conductive contacts (conductive terminals) 22 provided to the receptacle connector (second connector) 2 and the main wiring board B, to be covered with the conductive cover part 14*d* from above. Therefore, electromagnetic shielding of the solder connection part (connecting portion) 22*a* is performed simultaneously with the operation of rotating the fit-in rotating arm 14 when both of the connectors 1 and 2 fit in together. Thus, unlike the conventional art, the number of manufacturing processes for electromagnetic shielding is not increased.

Also, since the solder connection part 22*a*, which is a connecting portion between the conductive contacts 22 of the receptacle connector (second connector) 2 and the main wiring board B, is not covered with the conductive cover part 14*d* until the fit-in rotating arm (fit-in holding member) 14 of the plug connector (first connector) 1 is rotated to the "fit-in acting position", the connection state at the connecting portion and others can be confirmed without being obstructed by the conductive cover part 14*d*.

Furthermore, according to the present embodiment, before the plug connector (first connector) 1 fits in the receptacle connector (second connector) 2 as a counterpart connector, the fit-in rotating arm (fit-in holding member) 14 provided to the plug connector 1 as a fit-in holding member is rotated from the "fit-in releasing position" to the "fit-in acting position". With this, the terminal electrode parts 12*a* of the conductive contacts 12 provided to the plug connector 1 are covered with the conductive cover part 14*d* to become in a protected state. Therefore, adherence of foreign substances, such as a solder material, to the terminal electrode parts 12*a* can be prevented, thereby ensuring excellent electrical connection.

Figure 8:
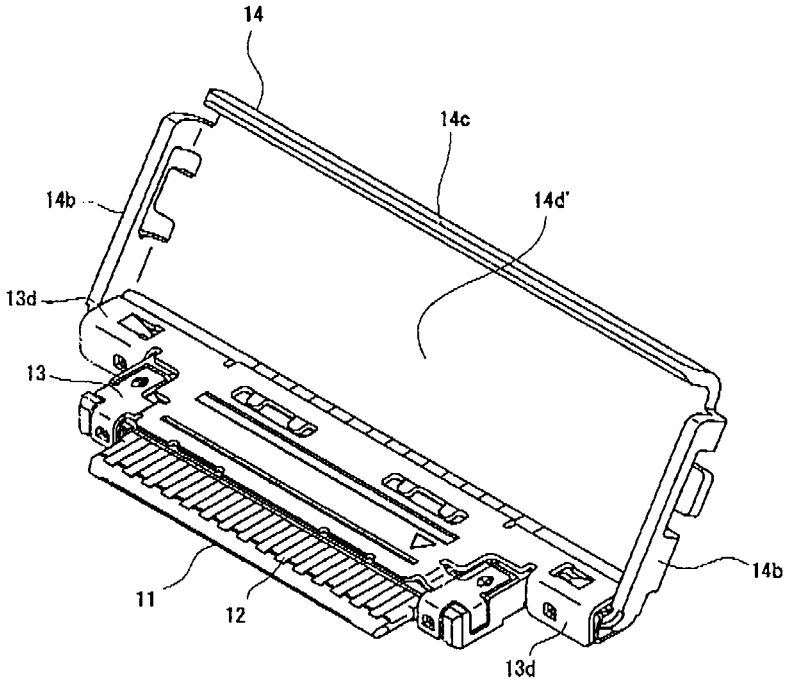
FIG. 8 is a descriptive external perspective view of the structure of a plug connector (a first connector) according to a second embodiment of the present invention.
Figure 9:
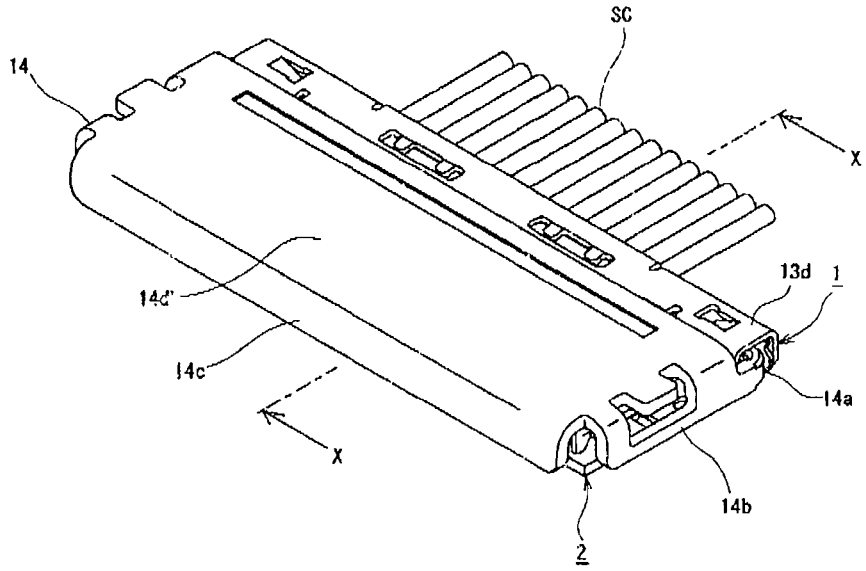
FIG. 9 is a descriptive external perspective view of an electric connector assembly in a state after the plug connector (the first connector) in the state of FIG. 8 is caused to fit in a receptacle connector (a second connector) as a counterpart connector and a fit-in rotating arm (a fit-in holding member) at a "fit-in releasing position) is rotated to a "fit-in acting position"
Figure 10:
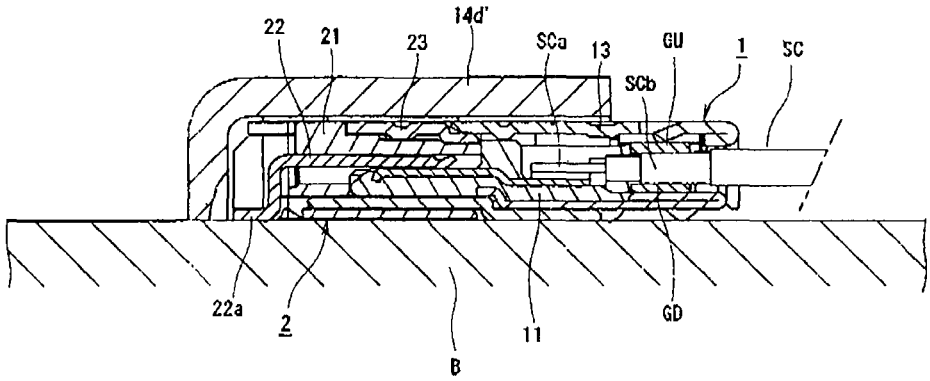
FIG. 10 is a descriptive cross-section view along an X-X line in FIG. 9.

Next, a fit-in rotating arm (a fit-in holding member) 14 provided as a fit-in holding member according to a second embodiment depicted in FIGS. 8 to 10 in which members identical to those in the first embodiment described above are provided with a same reference character includes a conductive cover part 14*d*' with the coupling arm parts 14*b*, 14*b* integrally coupled together. In the conductive cover part 14*d*', the rotating operation part 14*c* is formed on a rotating radius outer side of the fit-in rotating arm 14, and the conductive cover part 14*d*' is configured to be extended so as to cover the entire plug connector (first connector) 1.

The conductive cover part 14*d*' according to the present embodiment is configured to cover the upper surface and both side surfaces of the plug connector 1 when the fit-in rotating arm 14 as a fit-in holding member is rotated to the "fit-in acting position". On the other hand, as with the conductive cover part 14*d* of the first embodiment described above, the conductive cover part 14*d*' is configured to extend back from the ground connection tongues 13*a* so as not to cover the ground connection tongues 13*a*.

According to the present embodiment with the above-described structure, since the entire connector is covered with the conductive cover part 14*d*', a further better electromagnetic shielding function can be achieved. Also, with the conductive cover part 14*d*', the coupling arms 14*b*, 14*b* can be configured to be integrally coupled, thereby increasing the stiffness of the fit-in rotating arm (fit-in holding member) 14.

While the present invention made by the inventors has been specifically described, the present invention is not restricted by the above-described embodiments, and it goes without saying that the present invention can be variously modified within the scope not deviating from the gist of the present invention.

For example, while the fit-in rotating arm 14 as a fit-in holding member is provided to the plug connector 1 as the first connector in the above-described embodiment, it may be provided to the receptacle connector 2 as the second connector.

Also, while the conductive cover part is configured to cover the solder connecting part of the conductive contacts in the above-described embodiment, the structure can be such that another part is covered as long as it is part of the connecting portion with the main wiring board.

Furthermore, while the above-described embodiments are applied to an electric connector of a horizontal fit-in type, the embodiment can be similarly applied to an electric connector of a vertically fit-in type.

Still further, the present invention is not restricted to a coaxial cable connector as that of the embodiment described above, and can be similarly applied to an insulated cable connector, an electric connector of a type mixed with a plurality of coaxial cables and insulated cables, an electric connector having coupled thereto a flexible wiring board or the like, a board-to-board connector for connecting print boards together, and others.

As has been described in the foregoing, the present embodiments can be widely applied to various types of electric connectors for use in various electric devices.

What is claimed is:

1. An electric connector assembly comprising:

a first connector having coupled thereto a terminal part of a signal transmission medium formed of coaxial cables;

a second connector which the first connector fits in as being connected to a main wiring board in a mounted state; and a fit-in holding member provided to the first connector that is rotatable from a fit-in releasing position to a fit-in acting position in a state where both of the first and second connectors fit in together, the electric connector assembly being configured to maintain the state where both of the first and second connectors fit in together, wherein the fit-in holding member is provided with a conductive cover part covering a connecting portion between the second connector and the main wiring board when the fit-in holding member is rotated to the fit-in acting position in the state where both of the connectors fit in together.

2. An electric connector fitting in a counterpart connector mounted by being connected to a main wiring board in a state where a terminal part of a signal transmission medium formed of coaxial cables is coupled to the electric connector, the electric connector comprising:

a fit-in holding member provided to the electric connector that is rotatable from a fit-in releasing position to a fit-in acting position in a state of fitting in the counterpart connector, the electric connector being configured to maintain the state of fitting in the counterpart connector, wherein the fit-in holding member is provided with a conductive cover part covering a connecting portion between the counterpart connector and the main wiring board when the fit-in holding member is rotated to the fit-in acting position in the state of fitting in the counterpart connector.

3. An electric connector fitting in a counterpart connector mounted by being connected to a main wiring board in a state where a terminal part of a signal transmission medium formed of coaxial cables being coupled to the electric connector, the electric connector comprising:

a fit-in holding member provided to the electric connector, the electric connector being configured to maintain a state of fitting in the counterpart connector by the fit-in holding provided to the electric connector being rotated from a fit-in releasing position to a fit-in acting position in the state of fitting in the counterpart connector, the electric connector being provided with a conductive contact having a contact part in contact with a conductive contact of the counterpart connector at a time of fitting in the counterpart connector, wherein the fit-in holding member is configured to cover at least the contact part of the conductive contact when the fit-in holding member is rotated to the fit-in acting position in a state of not fitting in the counterpart connector.

4. The electric connector assembly according to claim 1, wherein the fit-in holding member includes a pair of coupling arm parts extending from rotational shaft parts provided at both ends in a connector longitudinal direction and a rotation operating part connecting both of the coupling arm parts, and the rotation operating part is provided with the conductive cover part.

5. The electric connector according to claim 2 or 3, wherein the fit-in holding member includes a pair of coupling arm parts extending from rotational shaft parts provided at both ends in a connector longitudinal direction and a rotation operating part connecting both of the coupling arm parts, and the rotation operating part is provided with the conductive cover part.

6. The electric connector assembly according to claim 1, wherein when the fit-in holding member is rotated to the fit-in acting position, the conductive cover part is configured to cover a connector upper surface and both of connector side surfaces.

7. The electric connector according to claim 2 or 3, wherein when the fit-in holding member is rotated to the fit-in acting position, the conductive cover part is configured to cover a connector upper surface and both of connector side surfaces.

* * * * *